US006024686A

United States Patent [19]

Madsen

[11] Patent Number: 6,024,686

[45] Date of Patent: Feb. 15, 2000

[54] DECANTER CENTRIFUGE WITH HELICAL-RIB BAFFLE

[75] Inventor: Bent Madsen, Gentofte, Denmark

[73] Assignee: Alfa Laval Separation A/S, Soborg, Denmark

[21] Appl. No.: 09/091,155

[22] PCT Filed: Dec. 18, 1996

[86] PCT No.: PCT/DK96/00544

§ 371 Date: Jun. 9, 1998

§ 102(e) Date: Jun. 9, 1998

[87] PCT Pub. No.: WO97/22411

PCT Pub. Date: Jun. 26, 1997

[30] Foreign Application Priority Data

Dec. 18, 1995 [DK] Denmark ..... 1432/95

[51] Int. Cl.[7] ..... B04B 1/20

[52] U.S. Cl. ..... 494/54

[58] Field of Search ..... 494/52–54; 210/380.1, 210/380.3

[56] References Cited

U.S. PATENT DOCUMENTS

| | | | |
|---|---|---|---|
| 3,289,926 | 12/1966 | Hiller et al. . | |
| 3,885,734 | 5/1975 | Lee . | |
| 3,934,792 | 1/1976 | High et al. . | |
| 4,245,777 | 1/1981 | Lavanchy | 494/53 |
| 4,303,192 | 12/1981 | Katsume | 494/53 |
| 4,378,906 | 4/1983 | Epper et al. | 494/53 |
| 4,731,182 | 3/1988 | High | 494/54 |
| 5,509,882 | 4/1996 | Caldwell | 494/53 |
| 5,643,169 | 7/1997 | Leung et al. | 494/53 |
| 5,653,673 | 8/1997 | Desai et al. | 494/53 |

FOREIGN PATENT DOCUMENTS

| | | |
|---|---|---|
| 111110 | 6/1968 | Denmark . |
| 126090 | 6/1973 | Denmark . |
| 1482719 | 1/1970 | Germany . |
| 2104848 | 12/1972 | Germany . |
| 329128 | 9/1970 | Sweden . |
| 7312110 | 10/1984 | Sweden . |
| 1408997 | 10/1975 | United Kingdom . |

*Primary Examiner*—Charles E. Cooley
*Attorney, Agent, or Firm*—Browdy and Neimark

[57] ABSTRACT

The decanter centrifuge has a bowl with a screw conveyor having a body (4) and a screw (7). Material to be separated into a light phase is supplied through inlet ports (6) in the body, and the heavy phase is discharged through discharge ports in the bowl at one end of the conveyor. Between the inlet ports and the discharge ports for the heavy phase, the body of the screw conveyor carries a baffle (8*c*), generally shaped as a radial rib which forms a helical surface turning in the same direction as the screw (7). Owing to its shape the baffle actively contributes to the transport of the heavy phase, and with retention of the same gap between the baffle and the inner surface of the bowl, the gap area can be increased by increasing the axial length of the baffle.

13 Claims, 4 Drawing Sheets

DECANTER CENTRIFUGE WITH HELICAL-RIB BAFFLE

FIELD OF THE INVENTION

The present invention relates to a decanter centrifuge for separation of a material supplied into a light phase and a heavy phase.

DESCRIPTION OF THE RELATED TECHNOLOGY

Decanter centrifuges generally have an elongated bowl adapted for rotation about its longitudinal axis, a screw conveyor arranged in the bowl and coaxial therewith and comprising a body carrying a screw, inlet ports in the screw conveyor for supply of the material to be separated, and discharge ports for the heavy phase in the bowl at one end of the conveyor, the screw conveyor being adapted to rotate in relation to the bowl for transporting the heavy phase towards the discharge ports for the heavy phase, and a baffle which is arranged between the inlet ports and the discharge ports and the radial extent of which in any axial position is smaller than the radial extent of the screw in the same axial position, the baffle extending from a position on the side of a flight of the screw of the conveyer facing towards the discharge ports to a position on the side facing away from the discharge ports of one of the flights of the conveyor screw following in the direction towards the discharge ports, without intersecting an intermediate flight.

U.S. Pat. No. 3,885,734 describes a centrifuge of this type, which has a baffle in the form of an annular disc arranged at right angles to the longitudinal axis of the conveyor. The baffle functions as a barrier preventing the light phase from moving towards the discharge openings for the heavy phase. With this barrier the decanter can be operated with unequal liquid levels on the light phase side and the heavy phase side of the baffle disc.

In the decanting process, the heavy phase is transported by the screw conveyor from the separation chamber constituted by the space between the inner surface of the bowl and the outer surface of the body of the conveyor, to the discharge ports for the heavy phase, and the baffle disc causes a reduction of the cross-sectional area available for this transport. Depending on the consistency and the quantity of the heavy phase, this restriction may result in an undesired large accumulation of heavy phase product on the light phase side of the baffle disc and create impaired inlet and separation conditions and in addition increase wear on the decanter as well as require a higher torque to maintain the relative motion between the conveyor and the bowl.

U.S. Pat. No. 3,934,792 describes a decanter centrifuge of the above mentioned type having a baffle generally in form of a flat, radial plate located across the helical chamber bounded by two adjacent screw flights, the outer surface of the conveyor body and the inner surface of the bowl. This baffle has the same disadvantages as the baffle known from U.S. Pat. No. 3,885,734 and because of its short length it reduces the cross-sectional area available for transport of the heavy phase to the discharge ports even more than the above mentioned prior art baffle. The baffle has a further disadvantage in that it does not have the same hand as the screw conveyor and therefore counteracts the transporting effect of the flights of the screw conveyor.

SUMMARY OF THE INVENTION

It is the object of the invention to provide a decanter centrifuge in which these disadvantages are reduced or completely eliminated.

According to the invention this is obtained in a decanter centrifuge of the type mentioned in the introduction in that the baffle takes the form of a helical rib having the same hand as the screw conveyor.

As the baffle is shaped like a helical rib handed in the same direction as the conveyor screw, it actively contributes to transporting the heavy phase towards the discharge openings in the same way as the screw, whereby the accumulation of the heavy phase on the upstream side of the baffle is reduced, the effect of which is that the disadvantages described above, caused by the accumulation, are reduced or completely eliminated. The baffle according to the invention has the added advantage that the transport area under the baffle can be increased in relation to the prior-art baffles by maintaining the same gap and extending the baffle over more than 360° of the circumference of the conveyor, thus giving it an axial extent longer than seen in prior art.

The baffle according to the invention also solves two problems existing in the prior-art baffles. The first problem is that in the area where the side of the flight of the screw facing towards the discharge ports, in the following called the downstream side, meets the baffle, a large accumulation of the heavy phase often occurs on the side of the baffle facing away from the discharge ports, in the following called the upstream side, which is due to the fact that the friction between the heavy phase and the outer wall of the bowl drives the heavy phase into the corner that is created between said surfaces. This excess of heavy phase can only get away in one way, viz., under the peripheral edge of the baffle where, however, the transport area is restricted, seen in relation to the large quantity of heavy phase. In the baffle in the centrifuge according to the invention this problem is completely eliminated as the place where the downstream side of the flight of the screw meets the baffle does not contain such a corner where the heavy phase can be accumulated. On the contrary, the heavy phase can be transported onwards by the baffle itself owing to its helical shape, and should this not be sufficient, the heavy phase can escape under the baffle to its upstream side.

The second problem of the prior-art baffles is that in the area where the upstream side of the flight of the screw meets the baffle, a shortage of heavy phase often arises on the upstream side of the baffle, because as mentioned above, the heavy phase has been accumulated in the corner between the downstream side of the flight of the screw and the upstream side of the baffle. This shortage of heavy phase causes the light phase in said area to penetrate under the periphery of the baffle and become mixed with the heavy phase already separated which is being transported by the screw towards the discharge ports for the heavy phase. This causes a not insubstantial reduction of the efficiency of the prior-art centrifuge. In the centrifuge according to the invention, this problem does not occur because the heavy phase in the area where the upstream side of the flight of the screw meets the baffle is pressed under the edge of the baffle by the friction between the heavy phase and the outer wall of the bowl so that no significant accumulation occurs.

In a preferred embodiment of the decanter centrifuge according to the invention the baffle may have a steadily increasing or decreasing pitch. By changing the pitch of the baffle, the transport capability of the baffle can be varied as desired. In a second embodiment the baffle may have a constant pitch. This is especially suitable when the screw of the conveyor also has a constant pitch, as this prevents the spaces between the baffle and the adjacent screw flights from becoming too narrow.

In a third embodiment of the decanter centrifuge according to the invention, the enveloping surface of the baffle may be a conical surface. This renders it possible to vary the gap between the baffle and the inner surface of the bowl. If, for example, the baffle is arranged at the conical section of the bowl, and if the enveloping surface of the baffle has an apex angle which is smaller than the apex angle of the conical section of the bowl, the gap between the baffle and the bowl will be largest at the end of the baffle facing away from the discharge ports for the heavy phase and will be reduced in a linear manner towards the opposite end of the baffle. The distance from the axis of rotation to the periphery of the baffle is also reduced in a direction towards the discharge ports although the gap is reduced. This causes large heavy phase particles and firmly compressed heavy phase to pass under the periphery of the baffle where the gap is largest, while less compressed heavy phase will be transported by the baffle towards the upstream side of the next screw flight and will thus protect against break-through of light phase also at the smallest radius to the peripheral edge of the baffle.

In a fourth embodiment the baffle can at each joint with the flights of the screw have a section substantially at right angles to the surface of the flight. By forming the baffle joint with the screw flight in this manner, the creation of a wedge-shaped corner between the baffle and the flight which may catch impurities, slurry and shreds and may be difficult to clean, is avoided. The embodiment is also advantageous in cases where the joint between baffle and screw is made by welding.

In a fifth embodiment the joining section of the baffle can at least one of the baffle ends, seen in a section at right angles to the longitudinal axis of the conveyor, be inclined so that the radially outermost part of the section is upstream of the radially innermost part seen in relation to the rotational direction of the conveyor in relation to the bowl. This means that heavy phase which, as mentioned above, has been pressed into a corner, can more easily escape under the peripheral edge of the baffle.

In further embodiments, conveyors with several grooves may have a baffle in each groove, and the design and position of the baffle may be the same in each groove. To avoid break-through of light phase in one of the grooves, each flight must have a baffle, and to avoid large centrifugal forces it is suitable for all baffles to be designed and arranged in the same manner in each groove.

In other embodiments the thickness of the baffle may be from 0.05 to 0.5 times the lead of the conveyor screw, preferably from 0.1 to 0.2 times the lead, especially 0.15 times the lead, or the thickness may be from 0.8 to 1.5 times the thickness of the screw flights, preferably 1.0 times the thickness of the screw flights. Increasing the thickness of the baffle achieves an increase in the frictional force between the heavy phase and the inner surface of the bowl, which results in an increase of the heavy phase quantity on the upstream side of the baffle. Thus, by changing the thickness of the baffle it is possible to adapt the centrifuge according to the invention better to certain operational conditions.

BRIEF DESCRIPTION OF THE DRAWING FIGURES

The invention will now be described in further detail below with reference to some embodiments and to the drawing, in which FIG. 1 in a somewhat schematic form shows a longitudinal section of a bowl and a screw conveyor with a prior-art annular baffle disc, FIG. 2 is a section on a larger scale of a centrifuge according to the invention, showing schematically a bowl and a screw conveyor with a baffle extending over 360° on a conical part of the screw conveyor, FIG. 3 is a view like FIG. 2, where the baffle is arranged on a cylindrical part of the conveyor, FIG. 4 is a view like FIG. 2, where the baffle is arranged partly on the cylindrical part, partly on the conical part of the screw conveyor, FIG. 5 is a view like FIG. 2, where the baffle extends over 90°, FIG. 6 is a view like FIG. 4, where the baffle extends over 720°, FIG. 7 is a view like FIG. 2 where the conveyor has a screw with two grooves, each groove having a baffle extending over 90°, FIG. 8 is a section on a larger scale of a centrifuge according to the invention showing a conveyor with screw flights at rights angles to the axis of the conveyor and a baffle forming an acute angle with said axis, FIG. 9 is a view like FIG. 8, the screw flights forming an acute angle with the longitudinal axis of the conveyor, and the baffle being at right angles to said axis, FIG. 10 is a view like FIG. 8, the screw flights forming an acute angle with the longitudinal axis of the conveyor, FIG. 11 is a view like FIG. 9, the screw flights forming an obtuse angle with the longitudinal axis of the conveyor, FIG. 12 is a cross-section in the conveyor along the line XII—XII in FIG. 2, FIG. 13 is a schematic view of a section of a conveyor in an unfolded state illustrating the area where the downstream side of a screw flight meets a prior-art baffle, FIG. 14 is a view like FIG. 13 for a centrifuge according to the invention, FIG. 15 is a view like FIG. 13 illustrating the area where the upstream side of a screw flight meets a prior-art baffle, FIG. 16 is a view like FIG. 13 for a centrifuge according to the invention, and FIG. 17 is a view like FIG. 4 showing a baffle of a thickness larger than the thickness of the flights of the screw.

DETAILED DESCRIPTION OF THE PREFERRED EMBODIMENTS

Figure 1:
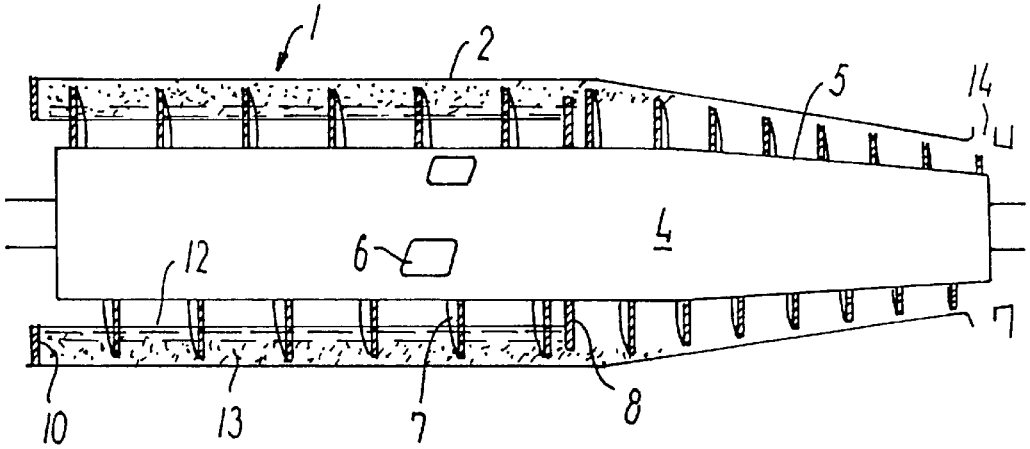
FIG.1 (PRIOR ART)

The decanter centrifuge in FIG. 1 has a bowl 2 with a screw conveyor 3 having a cylindrical body 4 with a screw 7 and a conical part 5 at one end. The conveyor 3 has inlet ports 6 for the substance to be separated, and the bowl 2 has discharge ports 14 for the separated heavy phase. As indicated in the figure, the light phase 12 is close to the body of the conveyor, while the heavy phase 13 is located at the inner surface of the bowl. The light phase is drained away over an outlet weir 10 on the bowl. The heavy phase is carried by the screw 7 towards the discharge ports 14 in the bowl at its conical end. The figure shows a prior-art baffle consisting of an annular disc 8 arranged at right angles to the longitudinal axis of the conveyor.

Figure 2:
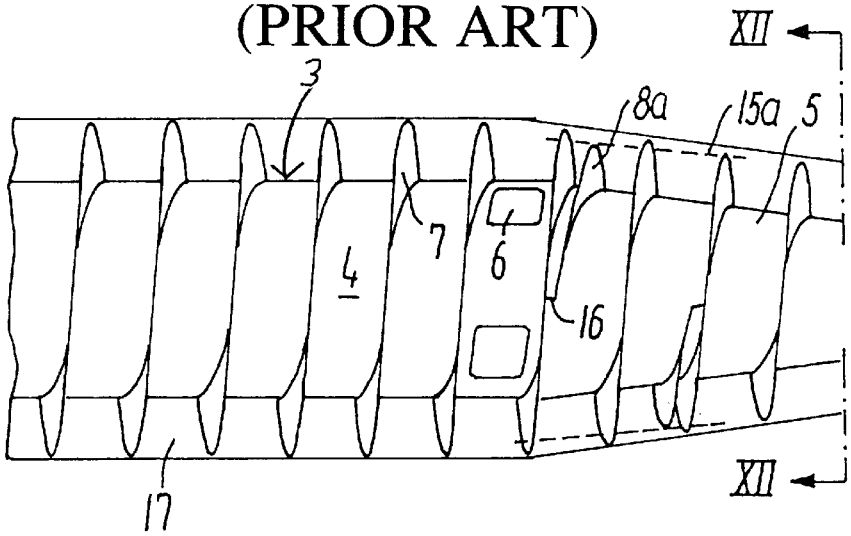

The centrifuge in FIG. 2 has a baffle 8*a* according to the invention where all of the baffle is located on the conical part 5 of the conveyor. The baffle 8*a* extends over an angle of 360°. As indicated by the dashed line 15*a*, the enveloping surface of the baffle is a cone with an apex angle smaller than the apex angle of the conical part 5 so that the gap between the periphery of the baffle and the inner surface of the bowl is larger at the end of the baffle facing away from the discharge ports 14 than at the opposite end.

Figure 3:
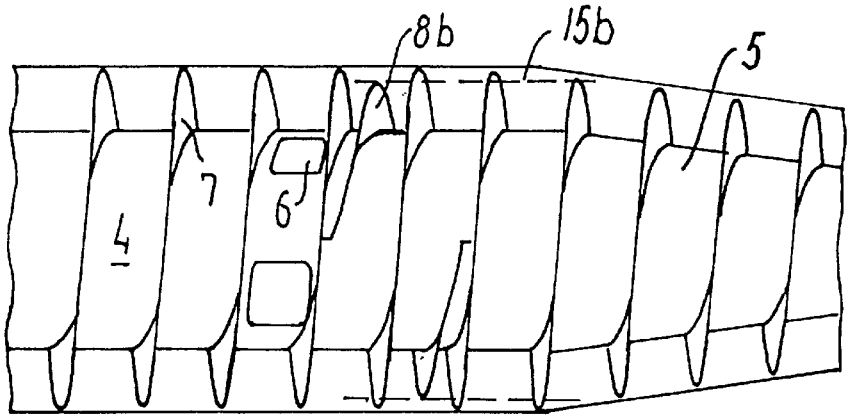

FIG. 3 shows a baffle 8*b* arranged on the cylindrical part of the conveyor. As indicated by the dashed line 15*b*, the enveloping surface of the baffle is a conical surface opening towards the conical part of the conveyor.

Figure 4:
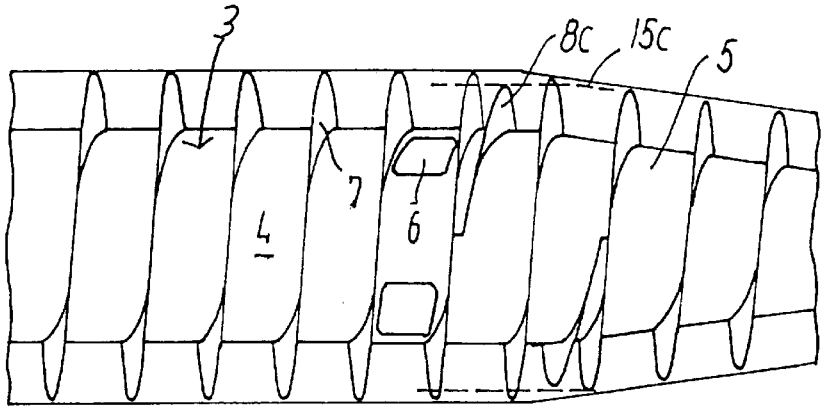

The baffle in FIG. 4 extends over 360° and extends over the transition between the cylindrical and conical parts of the conveyor. As indicated by the dashed line 15*c*, the gap between the periphery of the baffle 8*c* and the inner surface of the bowl is kept constant in the cylindrical part of the bowl, while it is reduced in the conical part of the bowl towards the end with the discharge ports 14. The transition between cylinder and cone surface in the enveloping surface of the baffle need not be arranged in the same axial position as the corresponding transition in the enveloping surface for the screw.

Figure 5:
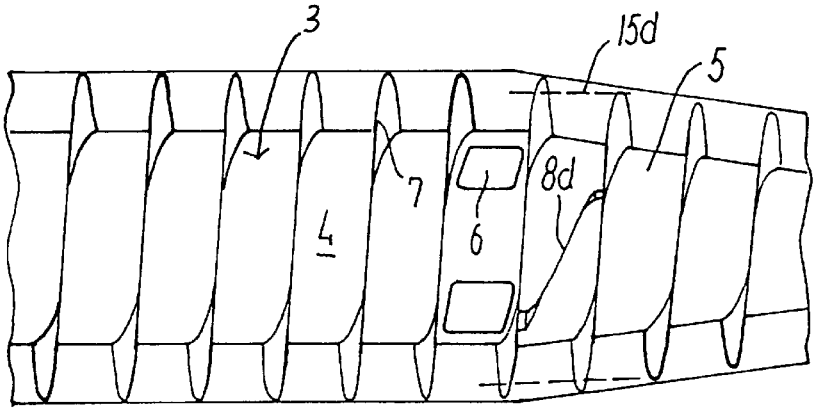

FIG. 5 shows a baffle 8*d* extending over 90°. As indicated by the dashed line 15*d*, the enveloping surface of the baffle 8*d* is a cone with an apex angle smaller than the apex angle of the conical section of the bowl.

Figure 6:
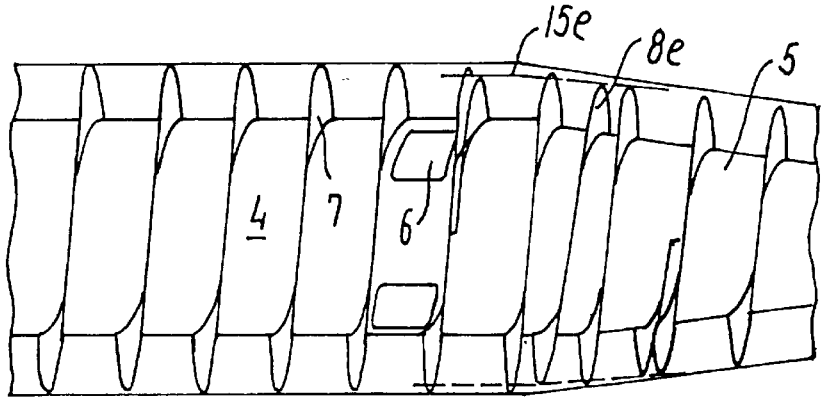

The baffle 8*e* in FIG. 6 extends over 720° with an enveloping envelope 15*e*, and the figure illustrates that without any problem baffles of considerable axial extent can be arranged in the centrifuge according to the invention.

Figure 7:
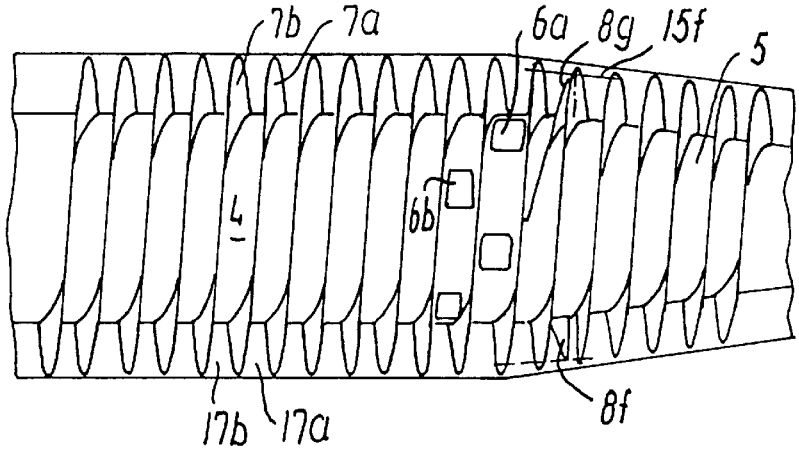

The conveyor illustrated in FIG. 7 has two grooves 17*a* and 17*b* with screw flights 7*a* and 7*b*. Each of the grooves has inlet ports 6*a* and 6*b*. Each groove has a baffle 8*f* and 8*g*, respectively. Each baffle extends over about 90°. The dashed line 15*f* indicates that the enveloping surface of the baffle is a conical surface with the same apex angle as the conical section of the bowl.

Figure 8:
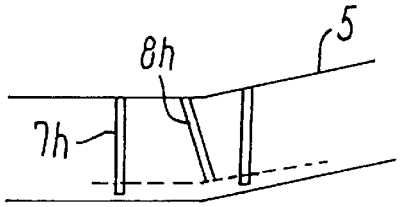
Figure 9:
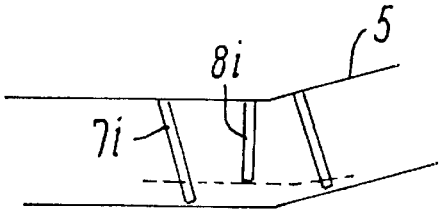
Figure 10:
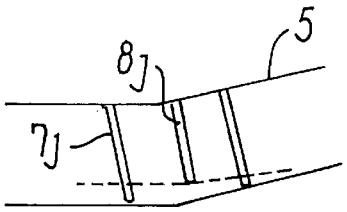
Figure 11:
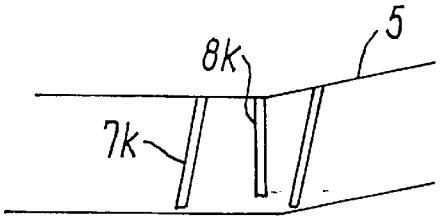

In the embodiments described above, the screw flights and the baffle were arranged at right angles to the longitudinal axis of the conveyor. However, this need not always be the case, and as shown in FIG. 8, the screw flights 7*h* are arranged at right angles to the longitudinal axis of the conveyor, while the baffle 8*h* forms and acute angle therewith. In FIG. 9 it is the baffle 8*i* which is at right angles to the longitudinal axis of the conveyor, while the screw flights 7*i* form an acute angle therewith. The screw flights 7*j* and the baffle 8*j* may, as shown in FIG. 10, be mutually parallel and form an acute angle with the longitudinal axis of the conveyor. Finally, FIG. 11 shows that the baffle 8*k* can be at right angles to the longitudinal axis of the conveyor, while the screw flights 7*k* form an obtuse angle therewith. FIGS. 8–10 clearly illustrate that a helical baffle can be used without any problem together with a screw, known per se, with inclined, so-called 'canted' flights.

Figure 12:
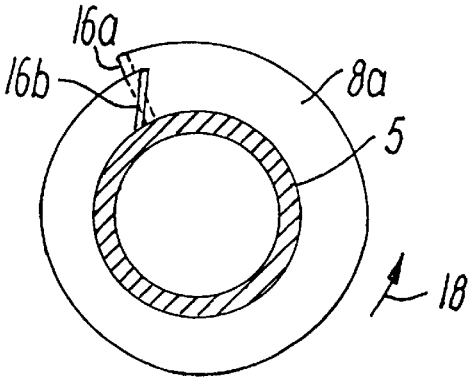

At one end the baffle 8*a* shown in FIG. 12 has a section 16*a* at right angles to a surface of a screw flight, not shown, while the section itself extends radially, as seen in cross-section. Where the other end 16*b* of the baffle meets the upstream side of the flight of the screw, its end section is also at right angles to the pertaining screw flight, but is inclined in such a manner that heavy phase passed in between the baffle and the screw can easily escape under the peripheral edge of the baffle when it meets this end section, so as to prevent heavy phase from accumulating at this place as explained in further detail below with reference to FIGS. 15 and 16. In the example shown, only one end section of the baffle is inclined, but the inclination can also be used at both end sections. The rotational direction of the conveyor in relation to the bowl is indicated by the arrow 18 in the drawing.

FIGS. 13–16 schematically show an developed section of the conveyor with the location of a screw flight and a baffle. The transport direction of the screw is indicated by the arrow s. The direction of the frictional force from the bowl affecting the heavy phase is indicated by the arrow f.

Figure 13:
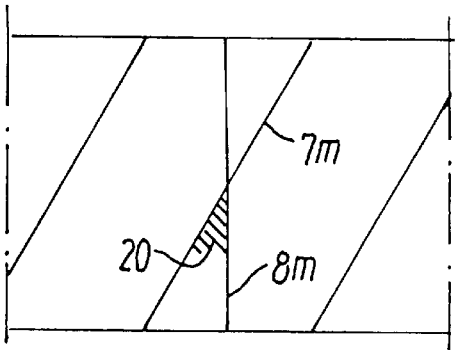
FIG. 13 (PRIOR ART)

The hatching in FIG. 13 indicates an area 20 which is located at the place where the downstream side of a flight 7*m* meets a prior-art baffle disc 8*m*. It can be seen that the flight will try to press the heavy phase in the direction of the arrow s, while the frictional force will try to press the heavy phase in the direction of the arrow f. The result is that an accumulation of heavy phase occurs in the area 20.

Figure 14:
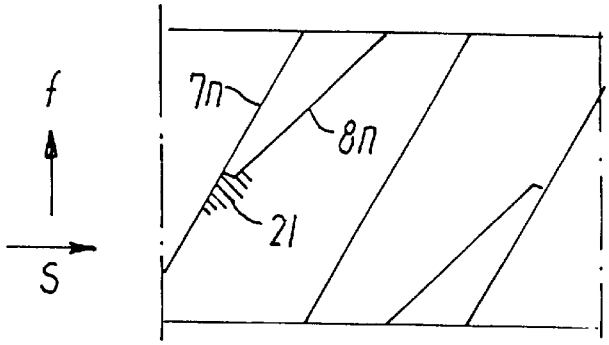

FIG. 14 shows the corresponding area 21 in a centrifuge according to the invention where the downstream side of a flight 7*n* meets a baffle 8*n*. In this area 21 the combined action of the flight 7*n* and the frictional force f will pass the heavy phase along the downstream side of the baffle 8*n*, from where the heavy phase owing to the baffle being shaped as a helical surface is easily transported on and at the same time flowing under the baffle.

Figure 15:
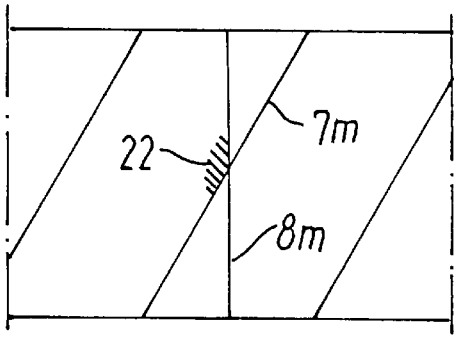
FIG. 15 (PRIOR ART)

FIG. 15 shows an area 22 located at the place where the upstream side of a flight 7*m* meets a known baffle disc 8*m*. In the area 22 there is a tendency for a shortage of heavy phase to arise, because the existing heavy phase partly is pulled away in the direction f of the frictional force, partly can easily escape in the direction s under the periphery of the baffle disc, while the flight 7*m* in connection with the baffle plate 8*m*, as explained above with reference to FIG. 13, blocks the supply of new heavy phase. The effect of this is that the light phase can penetrate under the periphery of the baffle disc, whereby light phase and heavy phase are mixed together on the heavy phase side of the baffle disc.

Figure 16:
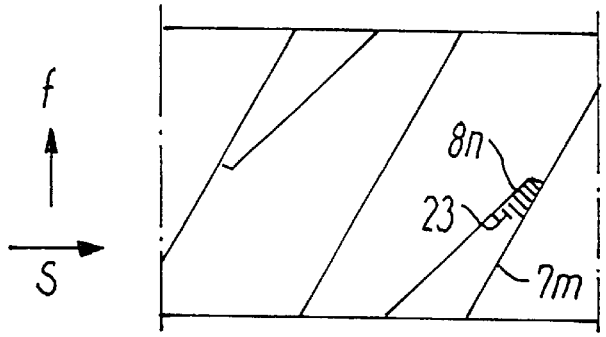

As shown in FIG. 16, said phenomenon does not occur in a decanter centrifuge according to the invention, the corresponding area 23 where the upstream side of the flight 7*n* meets the baffle 8*n*, now being an area where both friction and the screw transport effect will ensure a sufficient supply of heavy phase. If a tendency towards accumulation of heavy phase should occur, excess heavy phase can easily escape under the periphery of the baffle.

Figure 17:
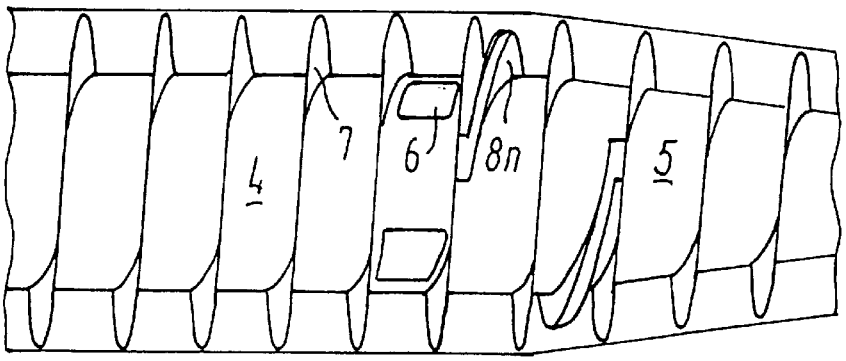

In the embodiment shown in FIG. 17, the baffle 8*n* has a thickness corresponding to 0.15 times the lead of the flight 7.

What is claimed is:

1. A decanter centrifuge for separation of a material supplied thereto into a light phase and a heavy phase, comprising an elongated bowl (2) adapted for rotation about its longitudinal axis, a screw conveyor (3) arranged in the bowl and coaxial therewith and comprising a body (4) carrying a screw (7), inlet ports (6) in the screw conveyor for supply of the material to be separated, and discharge ports (14) for the heavy phase in the bowl at one end of the conveyor, the screw conveyor being adapted to rotate in relation to the bowl for transporting the heavy phase towards the discharge ports for the heavy phase, and a baffle (8) which is arranged between the inlet ports and the discharge ports and the radial extent of which in any axial position is smaller than the radial extent of the screw in the same axial position, the baffle extending from a position on the side of a flight of the screw (7) of the conveyer (3) facing towards the discharge ports (14) to a position on the side facing away from the discharge ports of one of the flights of the conveyor screw following in the direction towards the discharge ports, without intersecting an intermediate flight, and the baffle having a periphery describing, during rotation of the screw conveyor, an enveloping surface of the baffle, wherein the baffle (8*a*) takes the form of a helical rib having the same hand as the screw conveyor (3).

2. The decanter centrifuge according to claim 1, wherein the baffle (8*a*) has a steadily increasing or decreasing pitch.

3. The decanter centrifuge according to claim 1, wherein the baffle (8*a*) has a constant pitch.

4. The decanter centrifuge according to claim 1, wherein the enveloping surface (15*a*) of the baffle (8*a*) is a conical surface.

5. The decanter centrifuge according to claim 4, wherein at at least one of the baffle ends, seen in a section at right angles to the longitudinal axis of the screw conveyor (3), a joining section (16*a*) of the baffle is inclined so that the radially outermost part of the section (16*a*) is upstream of the radially innermost part seen in relation to the rotational direction (18) of the screw conveyor in relation to the bowl (2).

6. The decanter centrifuge according to claim 1 wherein at each joint with the flights of the screw (7) the baffle (8*a*) has a section (16) substantially at right angles to the surface of the flight.

7. A decanter centrifuge according claim 1, wherein the screw conveyor (5) comprises a plurality of grooves (17*a*, 17*b*), each groove including a baffle (8*f*,8*g*).

8. The decanter centrifuge according to claim 7, wherein the design and location of the baffle (8*f*,8*g*) are the same in each groove (17*a*,17*b*).

9. The decanter centrifuge according to claim 1 wherein the thickness of the baffle is approximately from 0.05 to 0.5 times the lead of the conveyor screw.

10. The decanter centrifuge according to claim 1 wherein the thickness of the baffle is approximately from 0.8 to 1.5 times the thickness of the screw conveyor flights.

11. A decanter centrifuge according to claim 1, wherein a thickness of the baffle is from approximately 0.1 to approximately 0.2 times a lead of the conveyor screw.

12. A decanter centrifuge according to claim 1, wherein a thickness of the baffle is approximately 0.15 times the lead of the conveyor screw.

13. A decanter centrifuge according to claim 1, wherein the thickness of the baffle is approximately 1.0 times a thickness of the screw conveyor flights.

* * * * *